United States Patent [19]

Feuillade

[11] 4,204,660

[45] May 27, 1980

[54] PROCESS OF RAILROAD TIE CONCRETE CASTING

[75] Inventor: Jean-Louis J. Feuillade, Cagnes-sur-Mer, France

[73] Assignee: Societe B.M. Costamagna, Cagnes-sur-Mer, France

[21] Appl. No.: 935,994

[22] Filed: Aug. 23, 1978

[30] Foreign Application Priority Data

Aug. 26, 1977 [FR] France ..... 77 26046

[51] Int. Cl.[2] ..... B22D 19/08

[52] U.S. Cl. ..... 249/86; 104/17 A; 238/14.15; 238/30; 238/48; 238/350

[58] Field of Search ..... 249/86; 104/17 A; 238/14.15, 30, 48, 350; D12/49

[56] References Cited

U.S. PATENT DOCUMENTS

| | | | |
|---|---|---|---|
| 1,814,239 | 7/1931 | Backbee | 238/30 |
| 2,656,115 | 10/1953 | Sonneville | 249/86 |
| 2,719,676 | 10/1955 | Prater | 238/30 |
| 3,471,118 | 10/1969 | Bormann et al. | 249/86 |
| 3,834,620 | 9/1974 | Barlett | 238/30 |
| 3,894,687 | 7/1975 | Jacobson | 238/350 |

*Primary Examiner*—Paul R. Michl

*Attorney, Agent, or Firm*—Darby & Darby

[57] ABSTRACT

Apparatus for molding rail ties of the type which include one or more fastening devices embedded in the concrete of the type having a shoe plate which rests on the tie and a projecting tab part, the mold having plates, which are preferably removable inserts, for accepting the shoe portion of the device, and flexible jaws which engage the projecting tab part to align it with respect to the mold.

9 Claims, 7 Drawing Figures

PROCESS OF RAILROAD TIE CONCRETE CASTING

This invention concerns the manufacture of precast concrete railroad ties.

In such manufacture, or prefabrication, the molding operation must provide for forms, recesses and notches, needed for the subsequent adaptation of the tie fastening means, as well as the placement and inclusion in the concrete of parts to which the fastening means are connected or attached. To this end, the mold (generally the bottom part of the mold) is provided with the parts which define the appropriate recesses or forms and/or which support and position the parts intended to remain included in the concrete.

French patent application No. 77 09136, filed Mar. 28, 1977, describes a method and apparatus for the mass production molding of railroad ties. As can be seen from FIGS. 2 and 3 of this application, the bottoms of the molds are provided with means to create the forms intended for the placement of the fastening devices.

However, there are many fastening systems. According to one of these systems the tie comprises, incorporated in the molding, fastening tabs projecting from the surface of the tie on either side of the rail, in which holes are provided for the passage of spring retaining clips which press against the rail skid.

The object of this invention concerns an improved mold for the creation of ties intended to utilize this type of fastening means, as well as the related molding method for making such ties.

According to this invention the bottom of a mold for a railroad tie comprises, at the location of the fastening device, windows cut out in the shape of the shoes by means of which said devices rest on the tie. Under the bottom of the mold are provided jaws drawn to their closed position, these jaws being arranged on the bottom of the mold and shaped according to the form of the projecting tab part of the fastening device so as to assure their correct positioning.

The molding method according to the invention includes placing the fastening device in said windows and jaws, before placing the concrete, and causing the jaws to open and then close. Upon unmolding, the ties are extracted, causing the jaws to open.

The invention also concerns the following provisions, considered individually or in combination between them, or with the previous provisions:

(a) At the location of a pair of fastening devices, the mold comprises a plate provided with two windows shaped like the shoe of the devices and said plate carries the pretensioning and positioning jaws.

(b) Said plate is removable and adjustable in position.

(c) The jaws are retracted elastically to their closed position and arranged to open upon a thrust exerted by the tabs of the fastening device and to close again elastically, assuring the positioning of the devices by co-operation of their forms with those of said tabs.

(d) The jaws are formed by several spring leaves placed on edge with respect to the bottom of the mold and firmly fixed on a support with the plate.

(e) The ends of the springs have tangs which co-operate with the openings of the tabs.

(f) The jaws have stops which co-operate with the shoes of the fastening devices.

(g) The inner faces of the two windows are fabricated (machined) at a very precise distance and serve as a stop determing the spacing between the fastening device.

(h) The jaws comprise inclined lugs serving as stops for the tipping of the fastening device.

(i) The spring leaves are held between plates whose dimensioning serves to adjust the flexibility of said leaves.

The invention is illustrated by the attached drawings which represent a particular and non-limiting example of execution. In these drawings:

FIG. 1 in a view in cross-section of a type of rail fastening device for concrete ties of the type referred to in the invention.

Figure 1:
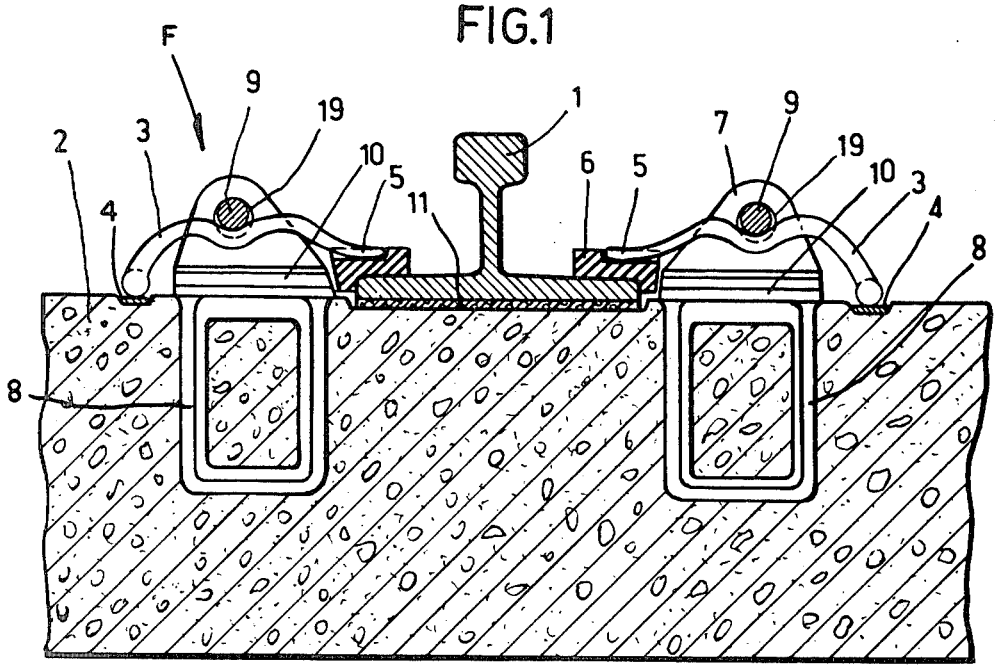

Referring to FIG. 1 it can be seen that in certain cases a rail 1 is fastened to a tie 2 by means of several opposed spring members 3 which bear at 4 against the tie and at 5 against the skid or rail 1 by means of chocks or frogs 6. Each spring 3 is shaped like a two-pronged fork extending on either side of a projecting tab 7 of a fastening device F which is anchored in the concrete of the tie at 8. A tab 7 stresses the spring 3 by means of a clip 9 passing through the eye 19 of the tab 7. Generally, a metal stop plate is provided at 4 to prevent the prong of the fork of spring 3 from punching through the concrete of the tie. The fastening device F tab 7 rests on the concrete of the top of the tie by means of a supporting shoe 10. An elastic sole 11 is often interposed between the rail 1 and the tie 2.

Now with reference to FIGS. 2 to 7, it can be seen that a mold 13 intended for the manufacture of ties provided with fastening devices of the type shown in FIG. 1 comprises, according to the invention, at the location of the fastening devices, windows 14 (FIG. 3) cut out in the shape of the shoes 10. Under the bottom of the mold are provided jaws 12 (FIGS. 2 and 6) whose forms co-operate with those of the parts of the projecting tabs 7 which are not set in the concrete, so as to assure their proper positioning at the approrpriate location.

In the example represented, the bottom of the mold 13 comprises, at the location of a pair of devices F, a plate 15, preferably removable or adjustable in position, provided with two windows 14 having essentially the shape of the shoes 10.

The jaws 12 are formed by leaves 18, placed on edge with respect to the bottom of the mold and fastened to the support 16 which is mounted with the plate 15. The ends of these spring leaves have rounded tangs or caps 17 which co-operate with the eye 19 of a projecting tab 7 thus providing in combination with the faces of window 14, the positioning of this tab which can be set in place by simple thrust of the tabs and forced spreading of the springs 18.

For more accurate positioning, the springs 18 advantageously comprise a terminal stop surface 20 (FIG. 6) against which rests the shoe 10 of a fastener device F and the inner faces 21 of the windows 14 are placed, accurately machined and set to the required distance tolerances. When a fastening device is set in place the stop 20 tends to cause it to tip until the opposite face of the shoe 10 comes in contact with the face 21.

Figure 6:
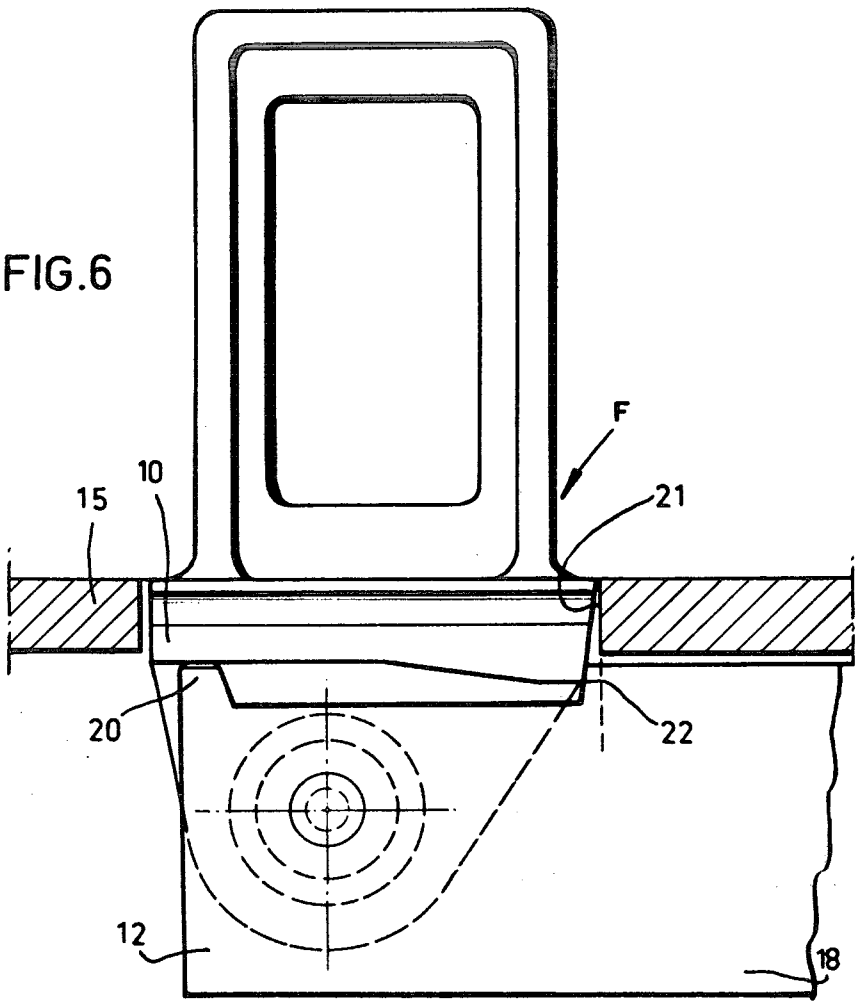
FIG. 6 is a detailed view of FIG. 2.
Figure 5:
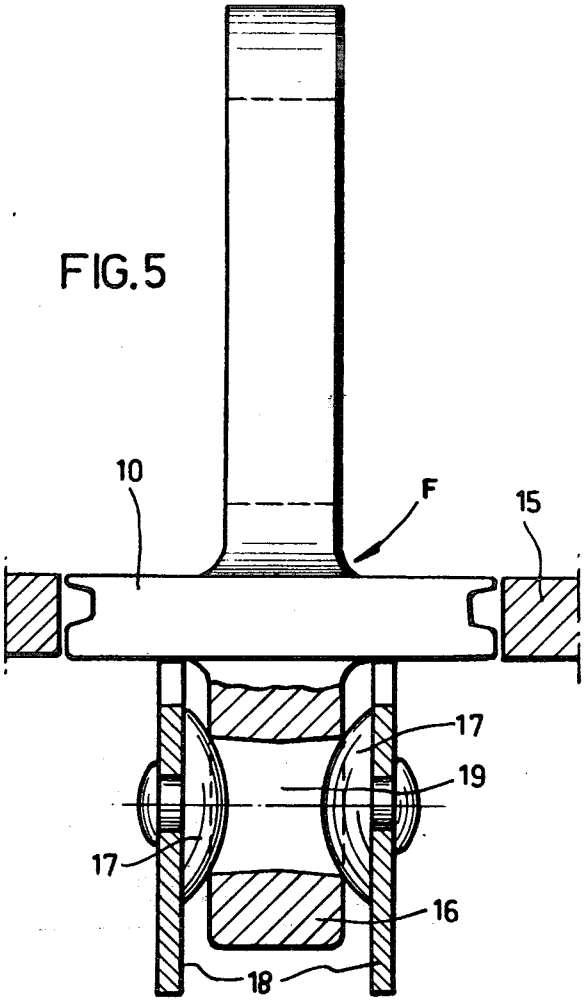
FIG. 5 is a detailed view in partial section along lines CC of FIG. 2 with a fastener device in place.

In addition, when the face in question of the shoe is set at an angle as represented in FIG. 6, it is advantageous to provide incined teeth against which said face of the shoe will bear. An inclined face 21 can also be provided.

With the arrangement represented, and particularly the jaws with tangs or caps 17, the molding method according to the inventin is particularly simple to carry out. Before pouring the concrete, the of the device F tabs 7 are merely forced into the spring jaws 18. Under this thrust these jaws open and close, trapping the eye 19, and the forms of the stops 20, 21, 22 assure the correct positioning of the devices. These cannot tip by rotation around the caps 17 owing to the stops 20 and to the shoes bearing on the faces 21 and the teeth 22. Nor can they oscillate laterally. Upon unmolding, a pulling force is merely exerted against the ties to force the jaws 18 to open and allow the tabs 7 to pass. Fastening of the plate 15 can be obtained as represented by positioning and bearing on the edges 23 and screwing or bolting at 24 into parts 25 solidly with the mold 13.

The leaves 18 are advantageously held between two plates 26 and 27 (interchangeable) whose dimensioning makes it possible to adjust the flexibility of the leaves 18 and therefore the tightening force of the jaws 12.

Figure 2:
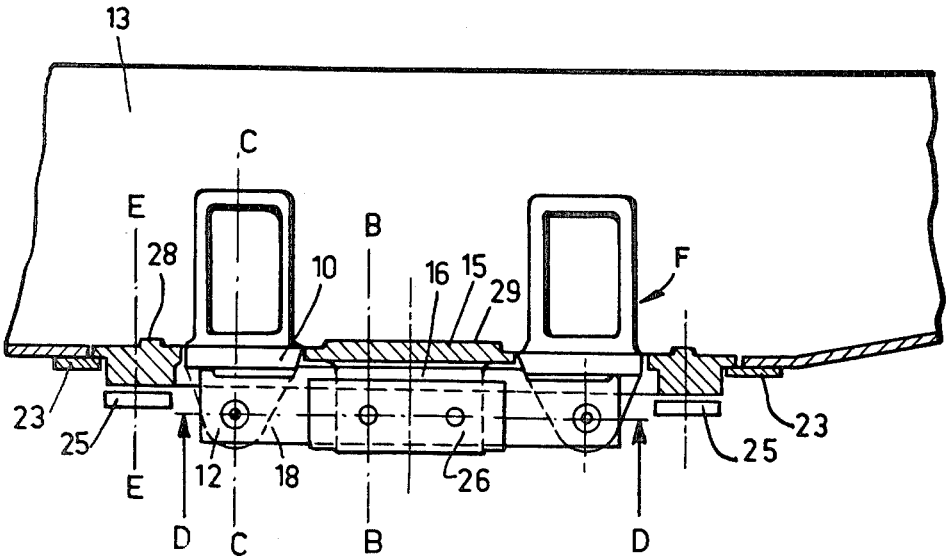
FIG. 2 is a schematic sectional view lines AA of FIG. 4 showing a part of the bottom of the mold provided with the means according to the invention with the fastening device set in place.
Figure 3:
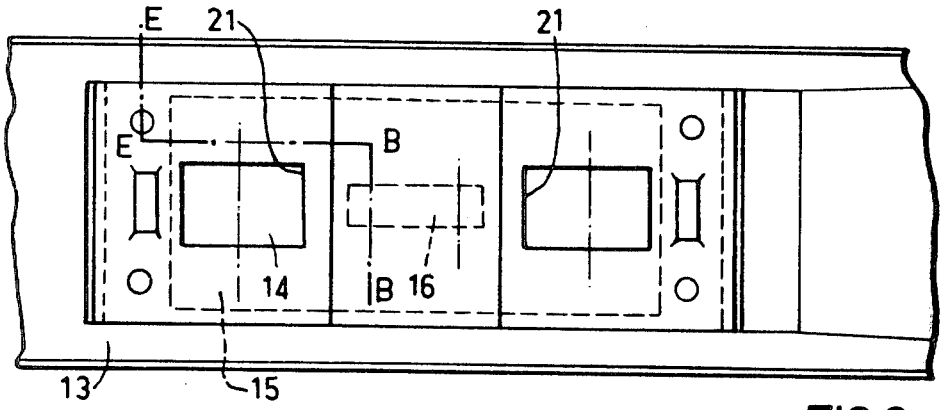
FIG. 3 is a schematic top view of the bottom of the mold of FIG. 2 without the fastening device.
Figure 4:
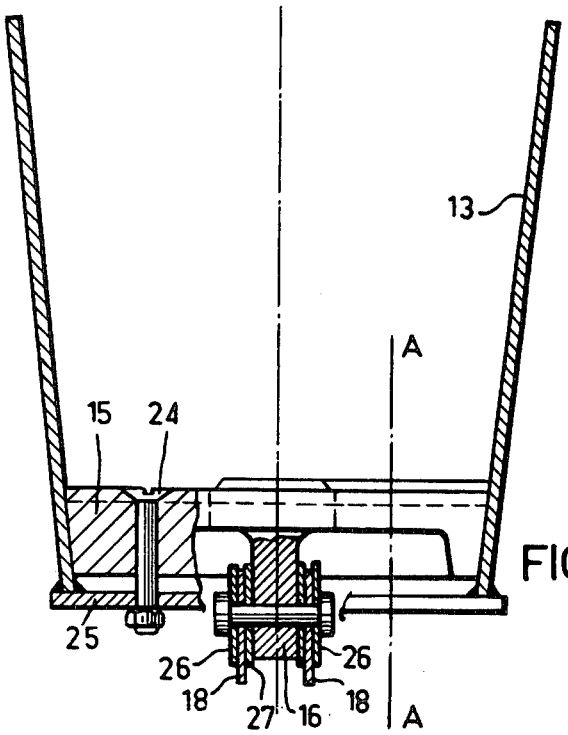
FIG. 4 is a partial sectional view along line EB of FIG. 3 without the fastening device.
Figure 7:
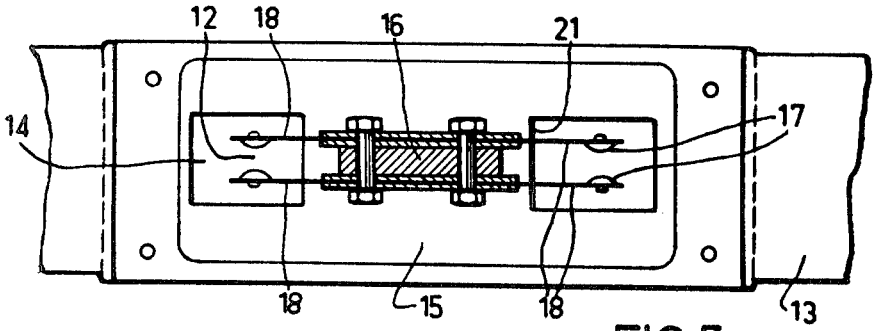
FIG. 7 is a section along lines DD of FIG. 2, with a bottom view of the bottom of the mold, without the fastener device.

The plates 15 comprise in addition the forms necessary for the spring supports 3 and the soles 11 of the rails 1 (FIG. 1) as represented at 28 and 29 (FIG. 2). They are preferably obtained by molding, in metal or in plastic.

In order to permit the placement according to pattern of the fastening devices, the plates 15 are preferably mounted adjustable in position on the bottom of the mold. Since they are removable it is possible, for a same mold, to have several sets of plates corresponding to different type or size fasteners.

Various modifications may be made in the execution of the invention, depending on the forms of the fasteners to be anchored in the concrete. Such an adaptation would not depart from the scope of the invention or the extent of the claims of the application. Thus the arrangement or the execution of the jaws 12 may assume various equivalent forms. Coil springs may be used instead of leaf springs. Also, a system of levers or jacks can be used to open and close the the jaws. Depending on the form of the upper ears of the fasteners, the stops and positioning forms carried by the jaws and/or the plate can or must be different in form or placement.

Likewise, inasmuch as the jaws are solid with the plates 15, it is equivalent to provide stops such as 20 and 22 carried by plates 15 instead of being carried by the jaws 12. This last solution is however, preferable because the jaws 12, at least as far as the stop surfaces are concerned, can be made of materials highly resistant to wear such as certain steels, while the plates 15, particularly if they are molded, can be made of less wear-resistant materials (e.g., plastic, aluminum, cast iron, etc.), as long as this resistance is suitable for the execution of a part of the modl 13.

For the pouring of concrete, the lower faces of the shoes 10 of the fastener devices F set in place close off the windows 14 and form a part of the bottom of the mold. It is preferable not to attempt an absolutely tight closure. A little slag will eventually flow through the joints between the shoes 10 and the windows 14 and this can be collected under the molds. This arrangement facilitates the placement of the fastening devices and permits higher production rates.

We wish therefore to be limited not by the foregoing description of a preferred embodiment of the invention, but, on the contrary, solely by the claims granted to us.

The embodiments of the invention in which an exclusive property of privilege is claimed are defined as follows:

1. Mold apparatus for manufacturing concrete ties of the type which include one or more fastening means having a shoe which is located at the top of the tie and a projecting tab portion, said apparatus comprising: a mold for the tie, a plate for attachment to said mold, said plate formed with an opening to accept the shoe of a corresponding fastening means, movable jaw means on the underside of said plate for engaging a predetermined part of the projecting tab portion of the fastening means to align the same with respect to the mold, and stop means on said plate which cooperate with said jaw means to align the shoe of a said fastening means with respect to the mold.

2. Mold apparatus as in claim 1 wherein said jaw means comprise resilient means which open to accept the projecting portion of a fastening means when the tab is moved through the opening of a said plate.

3. Mold apparatus as in claim 2 wherein said resilient means for the jaw means comprises a pair of opposed leaf springs.

4. Mold apparatus as in claim 3 wherein at least one of the leaf springs has a projecting portion at the end thereof to project with a corresponding opening of a tab projecting portion.

5. Mold apparatus as in claim 4 further comprising means for mounting said leaf springs including plates between which the leaf springs are held, the dimensioning of the plate with respect to the leaf springs determining the force of said leaf springs.

6. Mold apparatus as in claim 1 further comprising stop means on said jaws for engaging the shoe to align the fastening means.

7. Mold apparatus as in claim 1 wherein the inner faces of an opening serve as alignment means for the shoe with respect to the mold.

8. Mold apparatus as in claim 1 wherein said jaw means further comprises inclined teeth for engaging a tab to prevent tipping of the fastening means relative to said mold.

9. Mold apparatus as in claim 1 wherein said predetermined part of said projecting tab portion is a hole formed in said tab portion, said jaw means formed with means for fitting into said hole.

* * * * *